US006688295B1

(12) United States Patent
Miller

(10) Patent No.: US 6,688,295 B1
(45) Date of Patent: Feb. 10, 2004

(54) PULLEY ASSEMBLY FOR COMPOUND ARCHERY BOWS, AND BOWS INCORPORATING SAID ASSEMBLY

(76) Inventor: Larry Miller, 4030 Oak Tree Cir., Rochester, MI (US) 48306

( * ) Notice: Subject to any disclaimer, the term of this patent is extended or adjusted under 35 U.S.C. 154(b) by 0 days.

(21) Appl. No.: 10/340,033

(22) Filed: Jan. 10, 2003

(51) Int. Cl.[7] ..... F41B 5/10
(52) U.S. Cl. ..... 124/25.6; 124/900
(58) Field of Search ..... 124/25.6, 23.1, 124/24.1, 86, 88, 89, 900

(56) References Cited

U.S. PATENT DOCUMENTS

| | | | | |
|---|---|---|---|---|
| 3,486,495 A | | 12/1969 | Allen | 124/24 |
| 3,958,551 A | | 5/1976 | Ketchum | 124/24 R |
| 3,987,777 A | | 10/1976 | Darlington | 124/23 R |
| 4,060,066 A | | 11/1977 | Kudlacek | 124/23 R |
| 4,079,723 A | | 3/1978 | Darlington | 124/24 R |
| 4,103,667 A | | 8/1978 | Shepley, Jr. | 124/24 R |
| 4,203,412 A | | 5/1980 | Rickard | 124/23 R |
| 4,365,611 A | | 12/1982 | Nishioka | 124/24 R |
| 4,461,267 A | | 7/1984 | Simonds et al. | 124/23 R |
| 4,512,326 A | | 4/1985 | Jarrett | 124/23 R |
| 4,562,824 A | | 1/1986 | Jennings | 124/23 R |
| 4,718,397 A | | 1/1988 | Remick | 124/23 R |
| 5,368,006 A | | 11/1994 | McPherson | 124/25.6 |
| 5,505,185 A | | 4/1996 | Miller | 124/25.6 |
| 6,082,347 A | * | 7/2000 | Darlington | 124/25.6 |
| 6,474,324 B1 | * | 11/2002 | Despart et al. | 124/25.6 |

* cited by examiner

*Primary Examiner*—Jacob K. Ackun
(74) *Attorney, Agent, or Firm*—Gifford, Krass, Groh, Sprinkle, Anderson & Citkowski, P.C.

(57) ABSTRACT

A pulley assembly for use in an archery bow includes an axle journal which defines a pivot axis about which a pulley body can rotate. The pulley body includes a first, a second and a third groove defined therein. Each groove defines a curve which extends at least partway around the pivot axis. The first groove is a bow string groove operative to receive a portion of a bow string. The second groove is operative to receive a portion of a first bow cable section and the third groove is operative to receive a portion of a second bow cable section. The pulley assembly is incorporated into a compound bow, and when the bow string is unwound from the first groove, a portion of the first bow cable section is wound into the second groove and a portion of a second bow cable section is wound into the third groove. Also disclosed are compound bow configurations incorporating the pulley assembly.

18 Claims, 6 Drawing Sheets

PULLEY ASSEMBLY FOR COMPOUND ARCHERY BOWS, AND BOWS INCORPORATING SAID ASSEMBLY

FIELD OF THE INVENTION

This invention relates generally to archery. More specifically, the invention relates to compound bows; and most specifically, the invention relates to improve pulley assemblies for use in compound bows.

BACKGROUND OF THE INVENTION

In a compound archery bow, the force required to move the bow string (i.e. the draw force) varies as a function of the draw length. In a typical compound bow, the draw force is initially fairly high, and as the bow approaches a fully drawn condition, the force decreases. This "let off" in draw weight permits an archer to hold a fully drawn bow in a relatively steady position thereby providing an increase in accuracy. As a result of the let off and the force-draw characteristics of the bow, the amount of energy that can be stored is maximized thereby providing for a flatter path of travel of the arrow, higher arrow velocity, and an increase in the amount of energy delivered to the target. For these reasons compound bows are widely used by target shooters and hunters.

A typical compound bow normally includes two resilient limbs mounted upon a handle, two cable sections, a bow string and two pulley assemblies pivotally mounted at the tips of the limbs. The cable sections operate to compress the limbs in a controlled manner as the bow string is drawn, and the pulleys rotate to feed out and/or take up the cable and bow string. An arrangement of cams or levers generally disposed at the tips of the limbs of the bow, and operating through the cables, is employed to give a mechanical advantage as the bow is drawn and thereby modify the force draw curve.

An early compound bow design is disclosed in U.S. Pat. No. 3,486,495. The bow disclosed in this patent includes a cam/pulley arrangement at each end of the bow limb, and as such is referred to as a dual cam bow. In a typical dual cam design, one end of the bow cable is terminated and attached to a bow limb while the other ends wrap up on a groove in a pulley assembly, disposed upon the other limb, as the bow string is drawn. Difficulties arise in synchronizing the action of the two cams in dual cam bows of this type, and when the cams are out of synchrony, erratic arrow travel, and hence inaccuracies arise. While dual cam bows are still being utilized, the art has been turning to what is termed single cam bows. In bows of this type, the force multiplying cam action is provided by a single cam wheel/pulley assembly associated with one of the bow limbs. The other limb supports a pulley assembly which is referred to as an idler pulley, and this pulley does not exert any camming action. Use of a single cam bow eliminates problems of cam timing; however, problems still occur because the non-symmetrical nature of the bow performance causes the nock point of the bow string (that is to say the point on the bow string at which an arrow is supported) to travel in a non-linear path. This deviation from linearity adversely affects the flight characteristics of an arrow.

In response to problems of the early single cam bows, various hybrid designs have been developed in which the non-camming pulley operates to compensate for, and linearize, at least to some degree, nock point travel. One such hybrid bow assembly is disclosed in U.S. Pat. No. 5,505,185. In both single cam designs and hybrid designs, one of the cables operates in a manner similar to that of a dual cam bow; that is to say, one end of the bow cable is terminated and attached to a bow limb (or in some instances a pulley assembly), while the other end wraps up on a groove of a pulley assembly associated with the other limb, while the bow string is drawn. In the single cam and hybrid designs, the second pulley assembly operates to unwrap or feed out a cable from a groove in the pulley assembly while the bow string is drawn. In this manner, cable is fed from one pulley assembly and wound onto the other pulley assembly when the bow is drawn.

While hybrid designs provide performance which is superior to that of dual cam bows and conventional single cam bows, the pulley assemblies thereof are relatively complicated, and tend to be large and high in mass. This can cause problems of noise and vibration as well as increase the mass of the bow. All of these factors adversely affect performance. Therefore, it will be appreciated that there is still a need for improved compound bow assemblies which are simpler, lighter in weight, and easier to operate and maintain than are prior art bows. As will be appreciated from the drawings, discussion and description hereinbelow, the present invention provides an improved pulley assembly for compound bows. The pulley assembly of the present invention operates in a manner which is novel and distinct from prior art compound bow pulleys. The pulley of the present invention permits the manufacture of compound bows which are light in weight, relatively quiet, powerful and easy to maintain and use. The pulley assembly of the present invention may be employed in a number of bow designs and configurations as will be described hereinbelow.

BRIEF DESCRIPTION OF THE INVENTION

There is disclosed herein a pulley assembly for a compound bow. The pulley assembly comprises an axle journal which defines a pivot axis about which said pulley assembly is rotatable. The assembly further includes a pulley body. The pulley body includes a first, a second and a third groove defined therein. Each groove describes a curve which extends at least partway around the pivot axis. The first groove is a bow string groove operative to receive a portion of a bow string therein, the second groove is to receive a portion of a first bow cable section therein and the third groove is operative to receive a portion of a second bow cable section therein. The pulley assembly is configured and operative so that when it is incorporated into a compound bow so as to be rotatable about the pivot axis, and when the bow string is unwound from the first groove, a portion of said first bow cable section is wound into the second groove and said portion of said second bow cable section is wound into the third groove. The radii of one or more of the first, second and third curves may be constant or variable. In specific embodiments, when the bow string is unwound from the first groove, the rate at which the first bow cable section is wound into the second groove differs from the rate at which the second bow cable section is wound into the third groove. The pulley body may be a unitary body, or may be comprised of a plurality of subparts which are joined together. In such instance, the subparts may be positionally adjustable relative to one another.

The present invention also includes a compound bow which includes at least one of the pulley assemblies of the present invention.

DETAILED DESCRIPTION OF THE PREFERRED EMBODIMENTS

The present invention is directed to a pulley assembly which is incorporated into compound bows. The pulley assembly of the present invention is a dual take-up assembly insofar as in the operation of the bow, when the bow string is drawn, the pulley assembly of the present invention takes up portions of the bow cables. This is in contrast to prior art compound bow pulleys in which drawing of the bow string causes one or more cable segments to be let out from a pulley assembly. As discussed above, and as will be explained in greater detail herein below, this unique configuration and operation of the pulley of the present invention optimizes the performance characteristics of a compound bow. The pulley assembly of the present invention may be incorporated into a variety of bow designs and may be used with other pulley assemblies of the prior art, or it may form the sole pulley geometry of the compound bow.

Figure 1:
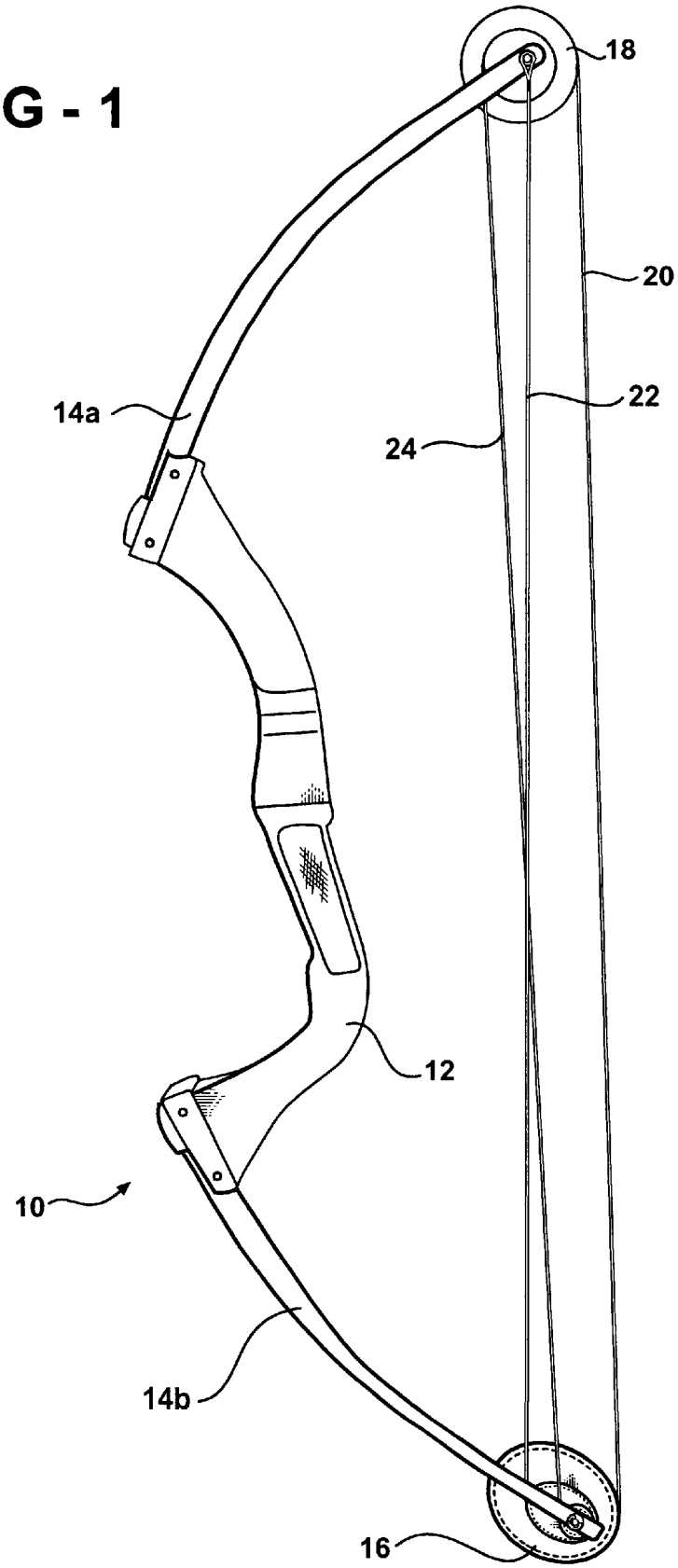
FIG. 1 is a side elevational view of a compound bow structured in accord with the principles of the present invention.

Referring now to FIG. 1, there is shown a compound archery bow 10 structured in accord with the principles of the present invention. The bow 10 includes a handle portion 12 having a first 14*a* and a second 14*b* resilient limb supported thereupon. As is known in the art, these resilient limbs 14 are flexible and function as energy storage devices in the operation of the bow. In that regard, the limbs may be made of composite materials such as glass or carbon fiber/polymer composites, wood, metal or such other materials as is known in the art. The limbs 14 may be integral with the handle portion 12 and formed from a similar material thereto; or they may comprise discrete members affixed to the handle 12. All of such arrangements are known in the art and may be employed in the present invention.

The bow 10 of FIG. 1 includes a pulley assembly 16 structured in accord with the principles of the present invention, and affixed to the free end of the second limb 14*b* so as to be rotatable thereupon. In the FIG. 1 embodiment, a second pulley wheel 18, of single take up, prior art design, is affixed to the free end of the first limb 14*a*. A bow string 20 runs between, and has its ends affixed to the pulleys 16 and 18 so that when the bow is in its undrawn condition as shown in FIG. 1, a segment of the bow string 20 is wrapped about each of the pulleys 16 and 18. When the string 20 is drawn, it unwinds from the pulleys 16 and 18 causing the pulley of the present invention 16 to rotate in a counter-clockwise direction (as shown in this view) and the prior art pulley 18 to rotate in a clockwise direction (as shown in this view). The bow further includes a first cable section 22 which has a first end thereof affixed to the first bow limb 14*a*, and a second end thereof affixed to the dual wind-up pulley of the present invention 16 so that, as will be explained in greater detail herein below, a portion of the first cable section 20 can be wound into and out of a second groove on the dual take-up pulley assembly. The bow includes a second cable section 24 having one end retained by the prior art, upper pulley 18, and a second end thereof retained by the dual take-up pulley 16 of the present invention so that a section of the second cable segment 24 can be wound into a third groove on the dual take-up pulley assembly 16 as the bow string 20 is wound therefrom.

As will be appreciated, when the bow string is drawn, the action of the cable sections 22 and 24, in conjunction with the pulleys, serves to compress the limbs 14*a* and 14*b* so as to store energy in the bow. Owing to the particular configuration of the pulleys 16, 18, the draw force imposed on the bow string 20, and the energy stored in the limbs 14*a*, 14*b* will vary as a function of the distance the bow string 20 is drawn. In the embodiments depicted herein the cable sections 22, 24 may comprise discrete, separate cables; or, they may be comprised of portions of a single cable; or, one or more may be contiguous with the bowstring. The specific configuration of cables and bowstring will be dependent on bow and pulley design, and the pulley of the present invention may be utilized with all of these various configurations.

Figure 2:
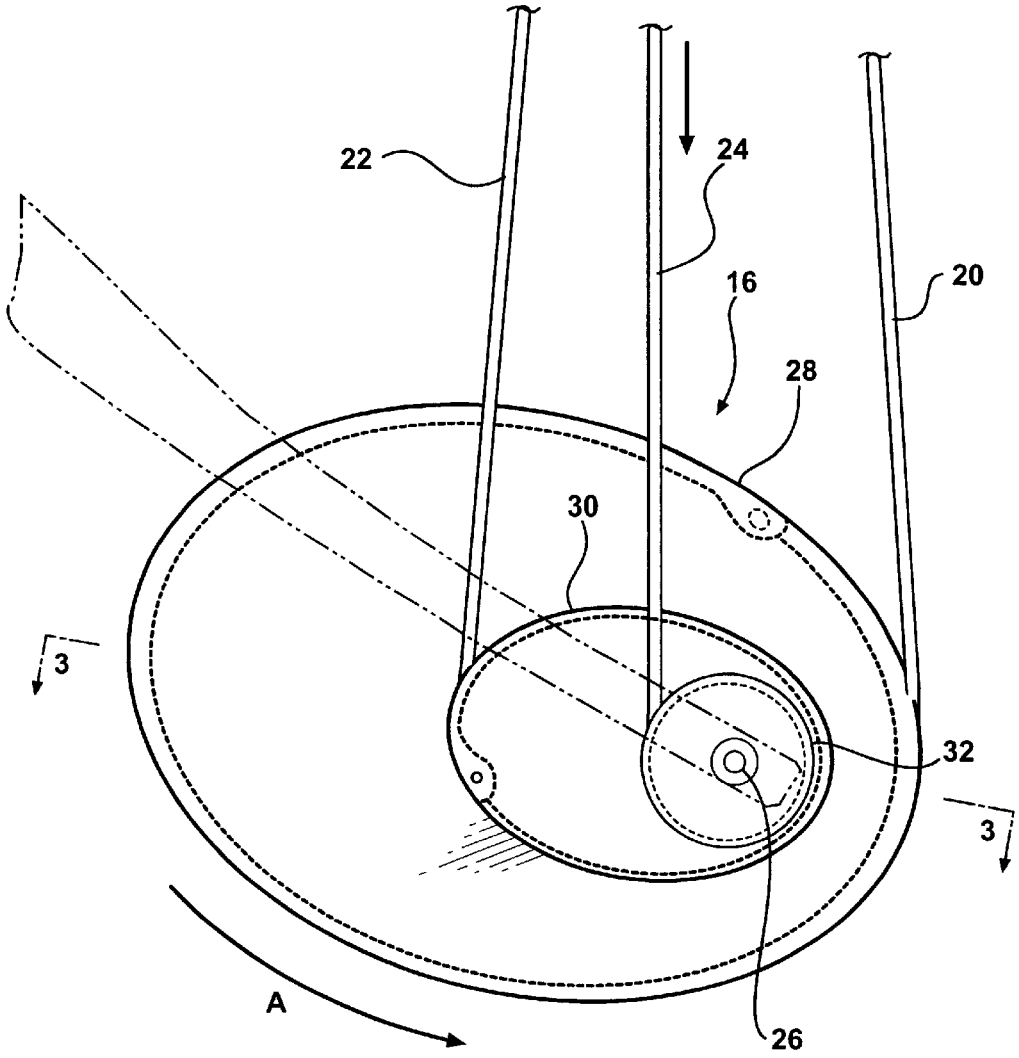
FIG. 2 is an enlarged view of a pulley assembly of the present invention of the type which is incorporated into the FIG. 1 embodiment.

Referring now to FIG. 2, there is shown an enlarged view of the dual take-up pulley assembly 16 of the present invention. The pulley assembly includes a journal 26 which is configured to receive an axle or other such support member. The journal defines a pivot axis about which the pulley 16 is rotatable. The body of the pulley includes a first groove 28, a second groove 30 and a third groove 32 defined therein. As depicted herein, the first groove 28 and third groove 32 are shown as being of constant curvature, and the second group 30 is of a varying curvature. It is to be understood that in accord with the present invention, all of the grooves may be of constant curvature, or all of the grooves may be of varying curvature. Also, as depicted herein, the third groove 32 is symmetrically disposed about the axis as defined by the journal 26, and the first groove 28 is eccentrically disposed with regard to the pivot axis. It is also to be understood that all of the grooves may be eccentrically disposed or all may be concentric with the pivot axis. All of such embodiments are within the scope of the present invention as defined herein.

As further depicted in FIG. 2, a portion of the length of the bow string 20 is retained in the first groove 28, a portion of the length of the first segment of bow cable 22 is retained in the second groove 30, and a portion of the length of the second bow cable segment 24 is retained in the third groove 32. The pulley assembly 16 is configured so that when the bow string 20 is drawn, the pulley will rotate in the direction of the arrow A, and this rotation will cause the second and third grooves 30, 32 to take up a portion of the length of the first cable segment 22 and second cable segment 24 respectively.

Figure 3:
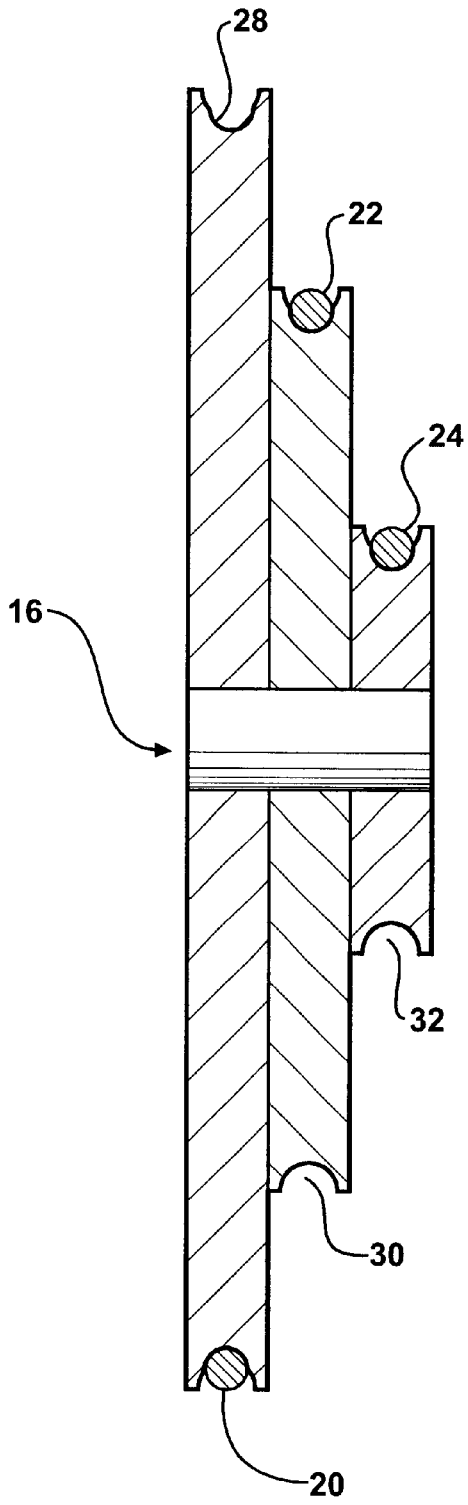
FIG. 3 is a cross-sectional view of the pulley assembly of FIG. 2 taken along line 3—3.

Referring now to FIG. 3 there is shown a cross-sectional view of the pulley assembly 16 of FIG. 2 taken along line 3—3. FIG. 3 better depicts the first groove 28, second groove 30 and third groove 32 as well as the journal 26 formed therethrough. FIG. 3 also depicts a portion of the bow string 20 as retained in the first groove 28, the first cable segment 22 as retained in the second groove 30, and the second cable segment 24 as retained in the third groove 32.

The pulley assembly of the present invention may be manufactured from metals, polymers, and composites. In some instances, the pulley assembly may comprise a unitary molded or machined member; while in other instances, the pulley assembly may be comprised of a plurality of separate parts permanently affixed to one another as for example by welding, adhesives or the like, or the assembly may comprise a plurality of separate parts which are movably affixed to one another by means such as screws, latches, clamps or the like. In other instances, the pulley assembly may include a number of alternative portions which can be substituted for one another so as to vary the pulley configuration. Use of such multipart pulley assemblies will allow for adjustment or customization of the draw length and other performance characteristics of the assembly. For example, in some instances, the relative eccentricities of the groove, the size of the grooves, the nature of the curvature of the grooves and the like may be selected so as to control the draw and firing characteristics of a bow in which the pulley is incorporated.

Figure 4:
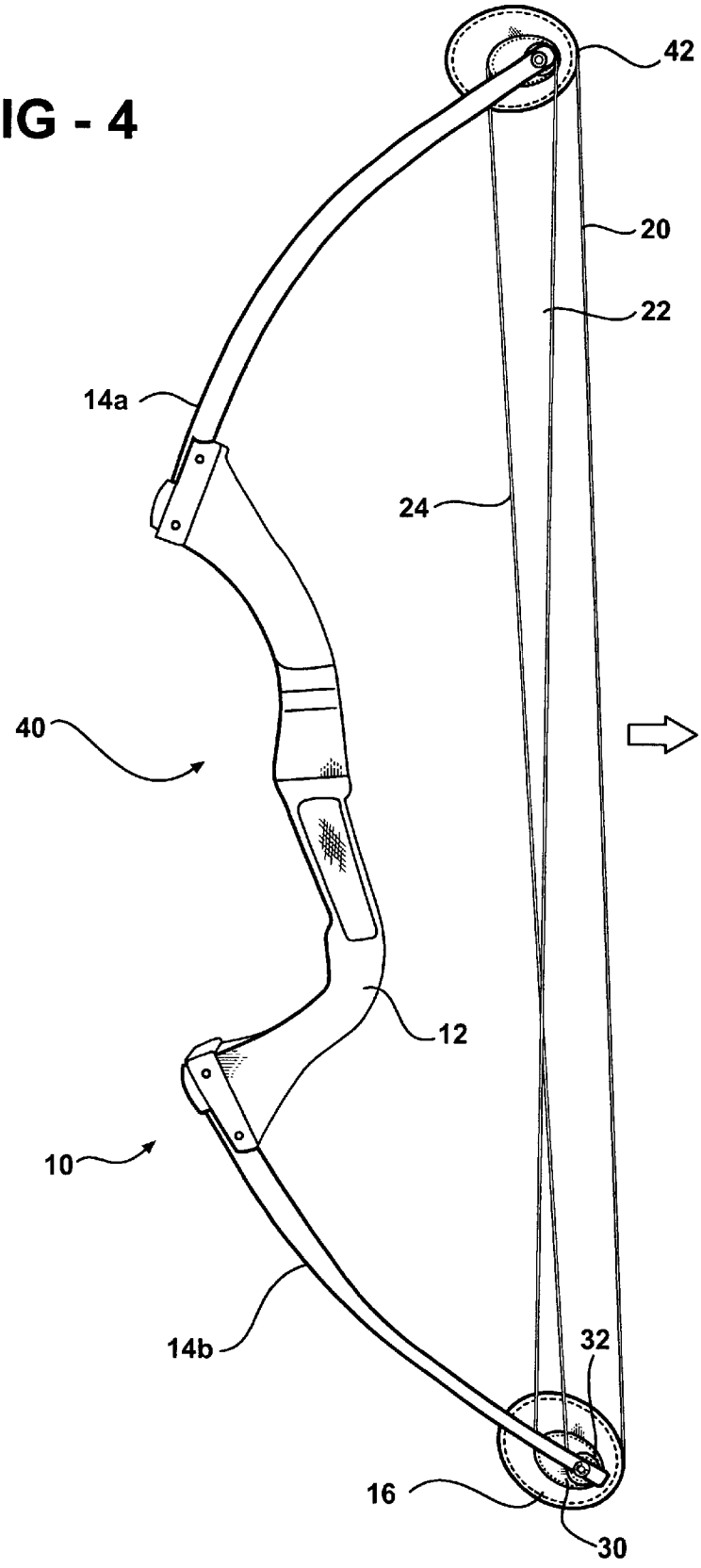
FIG. 4 is a side elevational view of another embodiment of compound bow structured in accord with the principles of the present invention.

The pulley assembly of the present invention may be incorporated into a number of compound bow designs, and in that regard may be employed in conjunction with other pulleys of various configurations. As is shown in FIG. 1, the pulley of the present invention may be utilized with a single letout pulley of the prior art. Referring now to FIG. 4, there is shown another embodiment of bow structure in accord with the present invention. The bow 40 of FIG. 4 includes a handle portion 12 and flexible limbs 14*a*, 14*b* as in the FIG. 1 embodiment. The FIG. 4 embodiment also includes a lower pulley 16 which is a dual take-up pulley of the present invention and may be generally similar to that shown in FIGS. 1–3. In the FIG. 4 embodiment, the upper pulley 42 is a dual feed-out pulley of the type known and used in the prior art. In this embodiment, a bow string 20 is affixed to the outermost groove portion of each pulley. A first cable section 22 is disposed so that a portion of that cable section 22 is retained by the upper pulley 42 so that when the bow string 20 is fed out of the upper pulley, a length of the first cable segment 22 is also fed from the upper pulley. The first cable section 22 also engages the second groove 22 of the dual take-up pulley of the present invention, and as described herein above, when the bow string 20 is fed out from the dual take-up pulley 16, a second portion of the length of the first cable section 22 is taken up by the pulley 16. A second cable section 24 is disposed so that a length thereof is retained by the upper pulley 42, and in this embodiment, it is wound onto the upper pulley 42 as the bow string 20 is drawn. A second portion of the second cable segment engages the third groove 32, and is also taken up thereby when the bow string 20 is drawn.

Figure 5:
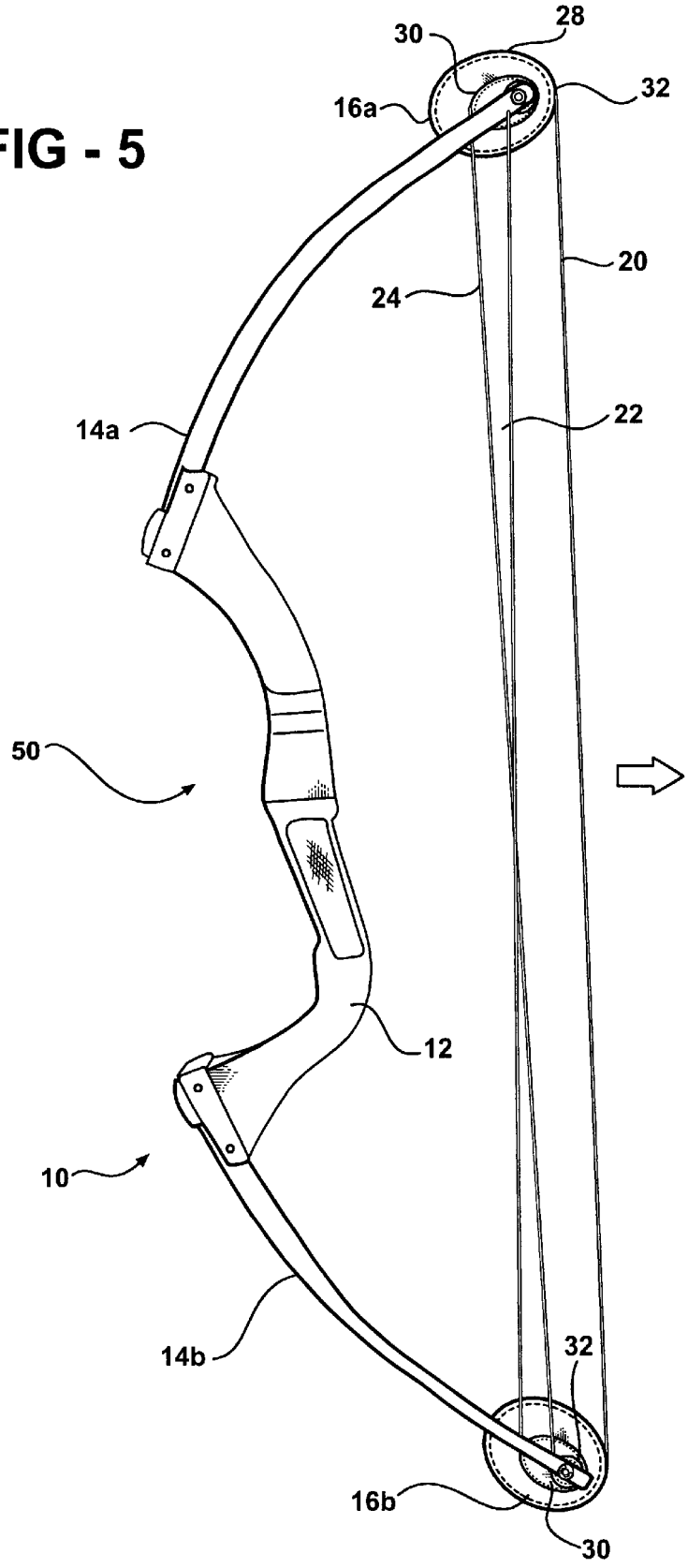
FIG. 5 is a side elevational view of yet another compound bow of the present invention.

Referring now to FIG. 5, there is shown yet another embodiment of bow structured in accord with the principles of the present invention. This bow 50 includes a handle portion 12 and flexible limbs 14*a*, 14*b* as previously described. This bow 50 differs from the previous embodiments in that both the upper pulley 16*a* and the lower pulley 16*b* are dual take-up pulleys in accord with the present invention; and in this regard, each of the pulleys 16 is generally similar to the pulley described with reference to FIGS. 1–3. As depicted, the bow string 20 engages the first groove 28 of each of the pulleys. A first cable section 22 has a first portion of its length wound into the second groove 30 of the bottom pulley 16*b*, and a second portion of its length wound into the third groove 32 of the upper pulley 16*a*. Conversely, a second cable section 24 has a first portion of its length wound into the third groove 32 of the bottom pulley 16*b*, and a second portion of its length wound into the second groove 30 of the upper pulley 16*a*. When the bow string 20 is drawn, the lower pulley 16*b* rotates in a first, counterclockwise direction, and the upper pulley 16*a* simultaneously rotates in a second, clockwise direction. This rotation causes the pulleys 16*a*, 16*b* to take up portions of the length of the cable sections 22, 24. Conversely, when the bow string 20 is released, the pulleys reverse their direction of rotation and let out the cable sections.

Figure 6:
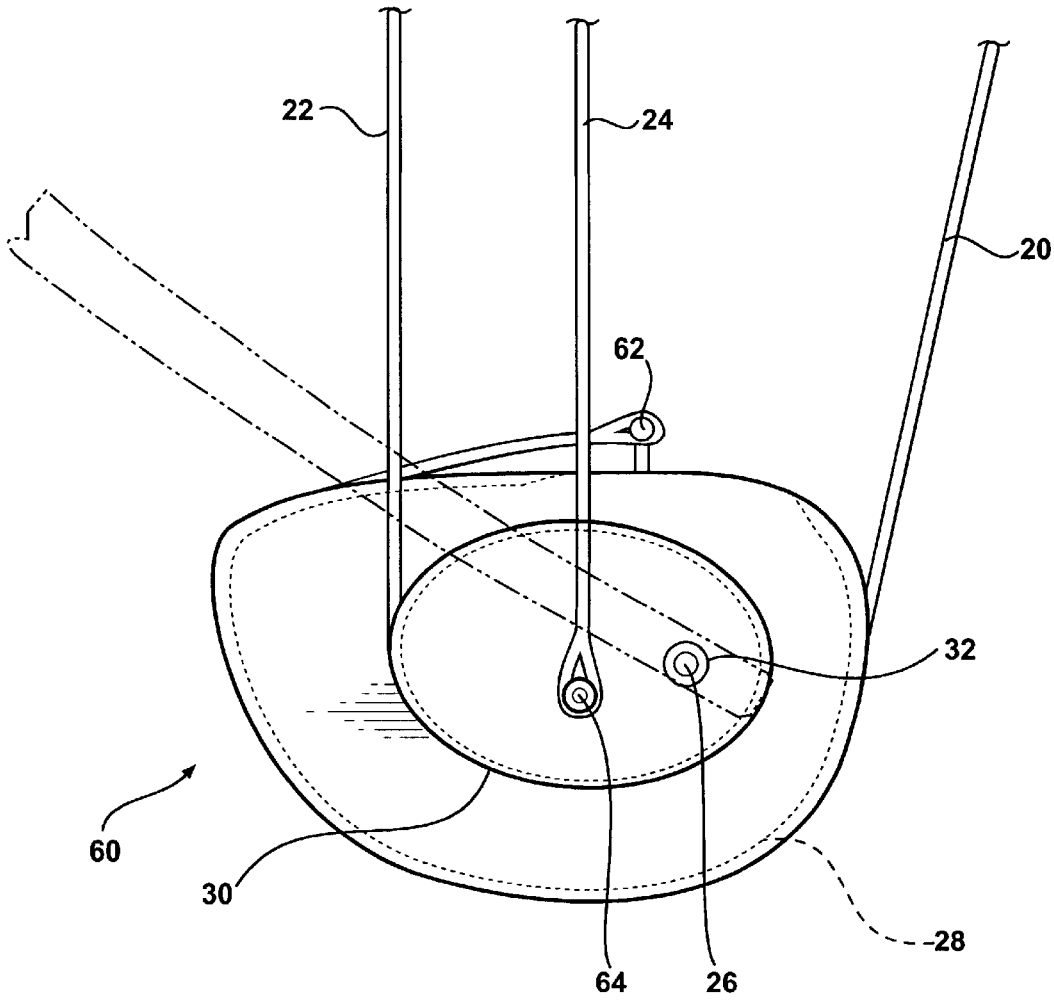
FIG. 6 is a side elevational view of another pulley assembly of the present invention which has a post take-up/feed configuration.

While in the foregoing illustrations, the cables are generally depicted as being anchored into the grooves of the pulleys, it is to be understood that the ends of the cables may be otherwise affixed to the body of the pulley assembly, or to some other portion of the bow. For example, post feed cable assemblies are known in the art, and post feed type configurations may be employed in connection with the pulley assembly of the present invention for feeding out and/or taking up the cables and/or bowstring. Referring now to FIG. 6, there is shown a dual take up pulley of the present invention 60 which incorporates a post take-up/feed configuration. As in the previous embodiments, the assembly 60 of FIG. 6 includes a first groove 28 which functions to retain a portion of the length of a bow string 20. In this specific embodiment, the first groove 28 extends only partway around the pivot axis as defined by the journal 26, and the end of the bow string 20 is anchored to a post 62 which is affixed to the pulley. When the bow is drawn, the bow string 20 unwinds from the first groove 28 as it is fed out. In some instances, the bow may be drawn to a sufficient length so that the entire end of the bow string 20 is free of the first groove 28, and is supported on the pulley assembly 60 by the post 62. In other instances, only a portion of the bow string 20 may be unwound from the first groove 28.

In the FIG. 6 embodiment, the first cable section 22 is retained in the second groove 30 as in the FIG. 2 embodiment. As is further shown in FIG. 6, an end of the second cable section 24 is supported on the pulley assembly by a second post 64 affixed thereto; and, when the bow is in an undrawn condition as is shown in FIG. 6, this second cable section 24 does not retain this second cable section 24. When the bow is drawn, the pulley assembly of FIG. 6 will rotate in a counterclockwise direction about the pivot axis as defined by the journal 26. A third groove 32 is brought into contact with the second cable 24 by the counterclockwise rotation which causes a portion of the length of the second cable 24 to be wound into the second groove 32. This FIG. 6 embodiment is illustrative of the manner in which post feed configurations may be adapted to the present invention. Yet other embodiments will be apparent to those of skill in the art.

It is to be understood that yet other configurations of compound bow may be implemented utilizing the pulley assembly of the present invention. In this regard, various other pulleys and cams may be utilized in combination with the assembly of the present invention and likewise, the assembly of the present invention may be incorporated into other designs of archery bows such as crossbows, bow configurations incorporating more than two pulley assemblies; as well as bow-type projectile launchers such as crossbows, slingshots or catapults utilizing flexible limbs, and other such variants. Also, the pulley assembly of the present invention may be implemented in embodiments other than those shown herein including, as noted herein above, multipart assemblies, assemblies in which the relative positional relationships of the grooves may be adjusted, embodiments in which the grooves are of a complex shape and the like.

The foregoing drawings, discussion and description are illustrative of specific embodiments of the invention; but, are not meant to be limitations upon the practice thereof. It is the following claims, including all equivalents, which define the scope of the invention.

What is claimed is:

1. A pulley assembly for a compound bow, said pulley assembly comprising:

an axle journal which defines a pivot axis about which said pulley assembly is rotatable; and a pulley body, said pulley body including: a first, a second and a third groove defined therein, each groove describing a curve which extends at least partway around said pivot axis; wherein said first groove is a bow string groove operative to receive a portion of a bow string therein, and wherein said second groove is operative to receive a portion of a first bow cable section therein, and said third groove is operative to receive a portion of a second bow cable section therein;

said pulley assembly being configured and operative so that when it is incorporated into a compound bow so as to be rotatable about said pivot axis, and when said bow string is unwound from said first groove, said portion of said first bow cable section is wound into the second groove, and said portion of said second bow cable section is wound into said third groove.

2. The pulley assembly of claim 1, wherein the curve defined by the first groove is separated from said pivot axis by a radius $R_1$, the curve defined by said second groove is separated from said pivot axis by a radius $R_2$, and the curve defined by the third groove is separated from said pivot axis by a radius $R_3$, and wherein at least one of $R_1$, $R_2$, and $R_3$ varies along the length of said curve.

3. The pulley assembly of claim 1, wherein when said bow string is unwound from said first groove, the rate at which said first bow cable section is wound into said second groove differs from the rate at which said second bow cable section is wound into said third groove.

4. The pulley assembly of claim 1, wherein said pulley body is a unitary body.

5. The pulley assembly of claim 1, wherein said pulley body is comprised of at least two subparts which are joined together.

6. The pulley assembly of claim 5, wherein at least two of said at least two subparts are positionally adjustable relative to one another.

7. The pulley assembly of claim 5, wherein the draw length of a bow in which the assembly is incorporated may be varied by varying the positional relationship of said at least two subparts.

8. The pulley assembly of claim 5, wherein one of said first, second and third grooves is disposed on a first one of said subparts, and another of said first, second and third grooves is disposed on another of said subparts.

9. A compound bow comprising:

a handle portion;

a first flexible limb supported by said handle portion;

a second flexible limb supported by said handle portion;

a pulley body pivotally mounted upon one of said limbs so as to be rotatable about a pivot axis, said pulley body comprising: a first, a second, and a third groove defined therein, each groove describing a curve which extends at least partway around said pivot axis;

a bow string having a portion of its length retained in said first groove of said pulley body so that when said pulley body is rotated about said pivot axis in a first direction, said portion of said length of said bow string is fed out of said first groove, and when said pulley body is rotated in a second direction, opposite said first direction, said portion of said length of said bow string is wound into said groove;

a first section of bow cable affixed to said pulley body so that a portion of said first section can be wound into said second groove when said pulley body is rotated in said first direction;

a second section of bow cable affixed to said pulley body so that a portion of said second section can be wound into said third groove when said pulley body is rotated in said first direction;

whereby when said bow string is drawn, said pulley body rotates in said first direction, and said portion of said length of said bow string is fed out of said first groove, and said portion of the first section of said bow cable is wound into the second groove, and said portion of said second section of said bow cable is wound into said third groove.

10. The compound bow of claim 9, further including a second pulley body which is pivotally mounted upon the other of said limb so as to be rotatable about a second pivot axis.

11. The compound bow of claim 10, wherein said second pulley body comprises a first, a second and a third groove defined therein, each groove describing a curve which extends at least partway around said second pivot axis, and wherein a second end of the first section of bow cable is affixed to said second pulley body so that a second portion of said first section of bow cable can be wound into the third groove of said second pulley body when said second pulley body rotates in said second direction; and wherein a second end of the second section of said bow cable is affixed to said second pulley body so that a second portion of said second section of bow cable can be wound into said second groove of said second pulley body when said second pulley body rotates in said first direction; whereby when said bow string is drawn, said first pulley body rotates in said first direction and said second pulley body rotates in said second direction, and first and second portions of said bow string are unwound from said first pulley body and said second pulley body respectively, and a first portion of the first section of bow cable is wound into the second groove of the first pulley body, a second portion of the first section of bow cable is wound into the third groove of the second pulley body, a first portion of the second section of bow cable is wound into the third groove of the first pulley body, and the second portion of the second section of bow cable is wound into the second groove of the second pulley body.

12. The compound bow of claim 9 further including an idler pulley affixed to the other of said flexible limbs.

13. The compound bow of claim 9 wherein an end of said bow cable is affixed to the other of said flexible limbs.

14. The compound bow of claim 9, wherein the first section of said bow cable, and the second section of said bow cable are defined by portions of a single cable.

15. The compound bow of claim 9, wherein the first section of said bow cable and the second section of said bow cable are comprised of separate cables.

16. The compound bow of claim 9, wherein at least one of said first, second and third grooves is a circular groove having a constant radius as measured from said pivot axis.

17. The compound bow of claim 9, when at least one of said first, second and third grooves is a non-circular groove having a varying radius as measured from said pivot axis.

18. The compound bow of claim 9, wherein at least one of said grooves includes a relatively straight portion.

* * * * *